United States Patent [19]

Foley, Jr.

[11] 4,154,417

[45] May 15, 1979

[54] ADJUSTABLE MOUNT FOR TROLLING MOTOR

[76] Inventor: John D. Foley, Jr., 3734 Woodrow, Shreveport, La. 71109

[21] Appl. No.: 850,599

[22] Filed: Nov. 11, 1977

[51] Int. Cl.[2] ..... B63B 17/00; B63H 21/26

[52] U.S. Cl. ..... 248/640; 115/17; 115/72

[58] Field of Search ..... 248/4, 284, 281; 115/17, 18 E, 41 R, 18 R

[56] References Cited

U.S. PATENT DOCUMENTS

| | | | |
|---|---|---|---|
| Re. 28,176 | 10/1974 | Horton | 248/4 |
| 596,931 | 1/1898 | Yunck | 108/115 |
| 804,696 | 11/1905 | Winterhoff | 403/43 X |
| 899,781 | 9/1908 | Anderson | 248/128 |
| 3,724,790 | 4/1973 | Harris et al. | 248/4 |
| 3,870,258 | 3/1975 | Shimanckas | 248/4 |
| 3,915,417 | 10/1975 | Norton | 248/4 |
| 4,033,530 | 7/1977 | Harris | 248/4 |

FOREIGN PATENT DOCUMENTS

| | | | |
|---|---|---|---|
| 1004 | 12/1915 | Netherlands | 248/4 |

*Primary Examiner*—J. Franklin Foss

*Attorney, Agent, or Firm*—Hill, Gross, Simpson, Van Santen, Steadman, Chiara & Simpson

[57] ABSTRACT

A mounting bracket for an outboard electric trolling motor has center and side arms for moving and supporting a propulsion motor, as for a fishing boat, between a submerged, outboard operating position and a retracted inboard, locked and secured storage position on the deck of the boat. An adjustable linkage is interposed between pivot axes on the side arms of the bracket for adjustment of the orientation of the motor shaft in the retracted storage position. Such adjustment selectively biases the propulsion motor housing downwardly onto a resilient pad on the bracket to cushion same against shocks occurring during trailering and during high-speed water operation of the boat. The adjustable linkage permits easy maintenance of any desired pre-load bias between the motor housing and the resilient pad despite changes in positioning of the depth of the motor in the water for best operation and despite manufacturing variations in pivot axis spacing, motor housing diameter changes, aging of the resilient pad, and other conditions.

12 Claims, 5 Drawing Figures

ADJUSTABLE MOUNT FOR TROLLING MOTOR

BACKGROUND OF THE INVENTION

1. Field of the Invention

The present invention relates to outboard electric fishing motors for boats and means for mounting and supporting same.

2. The Prior Art

Bass fishing boats now employed throughout the country have stern-mounted outboard gasoline engines for powering the boat relatively quickly from a dock to and among fishing areas and a quiet electric trolling motor, generally mounted on a flat-decked bow of the boat, for low-speed fishing operations. It is desirable to be able quickly to move the trolling motor from a submerged operating position to a retracted storage position and back again with minimum handling. For such purposes a variety of foldable mounting arrangements have been in common use at least since the early 1960's.

James Dale is believed to have used a bracket device around Shreveport, Louisiana, in the early 1960's, having a base plate with center and side arms pivotally mounted therefrom and connecting to a hinge or swivel bracket holding a shaft of the trolling motor in a vertical operating position and in a generally horizontal retracted storage position. In the Dale device, a forward, outboard pivot axis on the base plate connecting to the center arm is at a higher elevation than a rearward, inboard pivot axis of the side arms. By this configuration, the submersible propulsion motor is brought into resting contact on a resilient mounting pad in the storage position. In other mounting bracket devices, the pivot axes on the base plate may be at the same height, or the inboard axis may be higher than the outboard axis.

In the Dale and similar devices, differences in dimensions among the pivot axes from part to part, as well as aging of the parts and other factors can prevent satisfactory preloading of the motor housing onto the resilient pad, allowing the motor to bounce thereon under shock loads imposed during trailering on the highways and during high-speed water operation. No method or apparatus has heretofore been known to secure the motor in a locked position without use of auxilliary straps or stays.

SUMMARY OF THE INVENTION

A mounting bracket has center and side arms each extending between a fixed base plate and a hinge bracket holding a trolling motor shaft. The bracket arms position the shaft and a submersible motor thereon in and between an extended operating position and a retracted, locked storage position on the deck of a boat. The center arm or the side arms of the bracket have an adjustable length between pivot axes thereon which secure the arms to the base plate and the hinge bracket. Adjustment of such axis-spacing length in the retracted, locked position provides any desired angular adjustment to the hinge bracket and thus application of a selected preloading force between the submersible motor housing and a resilient pad receiving same on the base plate or boat deck.

THE DRAWINGS

THE PREFERRED EMBODIMENTS

Figure 1:
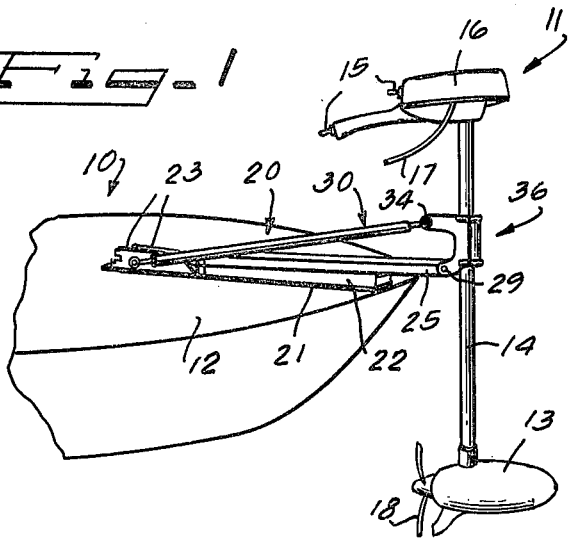
FIG. 1 is a perspective view of the bow of a fishing boat with a trolling motor and adjustable mount attached thereto.

A fishing boat 10 such as a bass boat useable in shallow water is shown in FIG. 1 with a trolling motor 11 mounted to a front deck 12 thereof. The trolling motor comprises a submersible electric motor housing 13 carried on a lower end of a pivot shaft 14 which, in the operating position shown in FIG. 1, extends generally vertically into a body of water in which the boat 10 is operated. Control switches 15 on a motor head 16 control the supply of power from a cable 17 and thus the speed and direction of rotation of a propeller 18.

Figure 2:
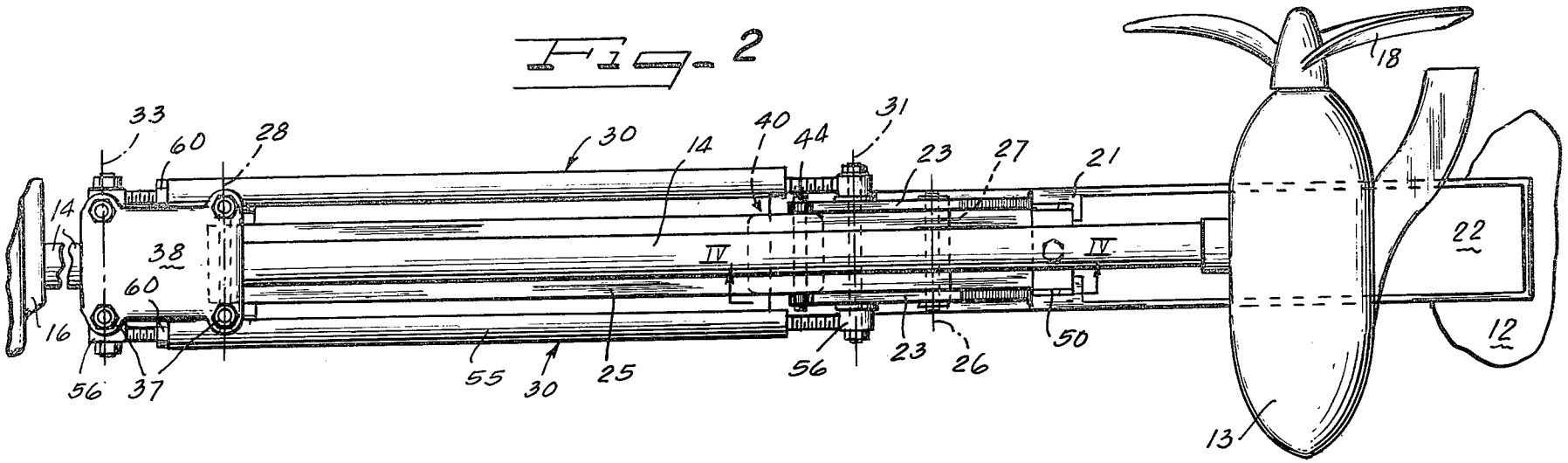
FIG. 2 is a top plan view of the adjustable mount in its retracted and locked position.
Figure 3:
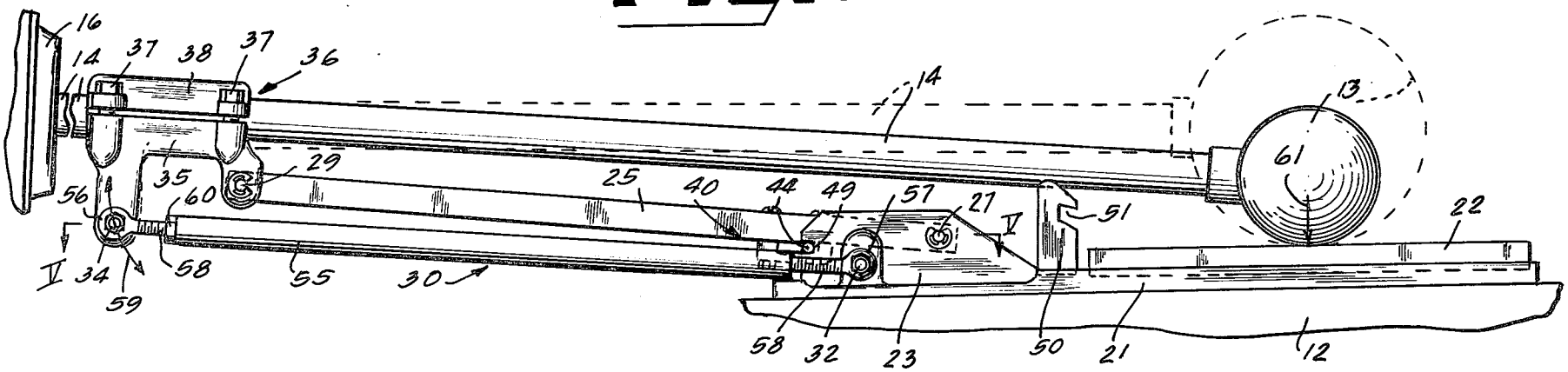
FIG. 3 is a side elevational view of the adjustable mount and trolling motor and showing effects of adjustment therein.

The trolling motor 11 is moved from the operating position shown in FIG. 1 to the retracted position of FIGS. 2 and 3 by means of a mounting bracket assembly 20. The assembly 20 comprises a base plate 21 secured to the deck 12 of the boat 10 in a generally fore and aft alignment. The base plate 21 is shown attached to the bow of the boat 10, but could equally well be attached to the stern or a side thereof for similar operation. A forward or outboard portion of the base plate 21 carries a resilient cushioning material or pad 22 comprising a rubber or similar material of relatively high density. A pair of parallel, upstanding ears are formed on the rear or inboard portion of the base plate 21, as shown in the Figures.

A center arm 25 is received on a first pivot axis 26 formed in a forward or outboard portion of the ears 23. A pivot pin 27 is secured by suitable means along the axis 26. An opposite end of the center arm 25 carries a second pivot axis 28 along which a pin 29 is carried, also retained in a suitable manner. A pair of side arms 30 are pivotally attached to the ears 23 at rearward or inboard locations on the ears at a common third pivot axis 31 along which is received a pin or bolt 32. An opposite end of each side arm 30 carries a fourth pivot axis 33 along which a further bolt or pin 34 is received.

The pivot axes 28, 33 and the corresponding pins 29, 34 connect the arms 25 and 30, 30, respectively, to lower and upper boss portions of an inboard half 35 of a divided cap hinge bracket 36 which receives and supports the motor shaft 14 therethrough. Nuts 37 attach an outboard half 38 of the divided cap hinge bracket 36 to the inboard half 35 and permit easy positioning of the shaft 14 along its length in the cylindric bore of the assembled hinge bracket 36. Such adjustment is helpful for changing the depth of submersion of the motor housing 13 and propeller 18, for operation in different fishing waters.

In the embodiment shown, the first, outboard pivot axis 26 and the pin 27 therealong are positioned somewhat higher off the deck 12 of the boat 10 than are the third pivot axis 31 and corresponding pin 32. Also, the center arm 25 is shorter, between the first and second pivot axes 26, 28 thereon, than are the side arms 30 between its pivot axes 31, 33. Finally, the second and fourth pivot axes 28, 33 are spaced further apart than are the first and third pivot axes 26, 31. Such relationships provide for smooth movement of the trolling motor 11 from the operating position of FIG. 1 to the retracted position of FIGS. 2 and 3. Other relationships among the parts, such as having the pivot axes 26 and 31 located at equal heights above the deck 12, or with the inboard axis 31 spaced higher than the outboard axis 26, may alternatively be employed under appropriate circumstances.

Figure 4:
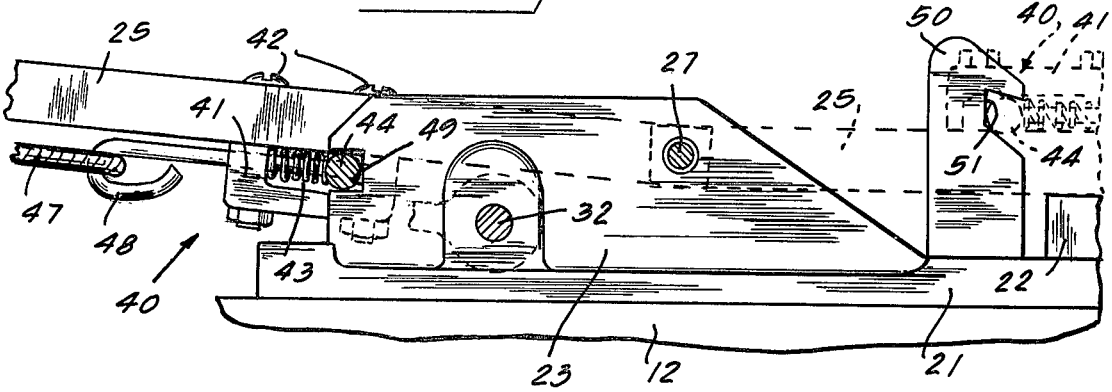
FIG. 4 is a side view, partly in section, taken on line IV—IV of FIG. 2.
Figure 5:
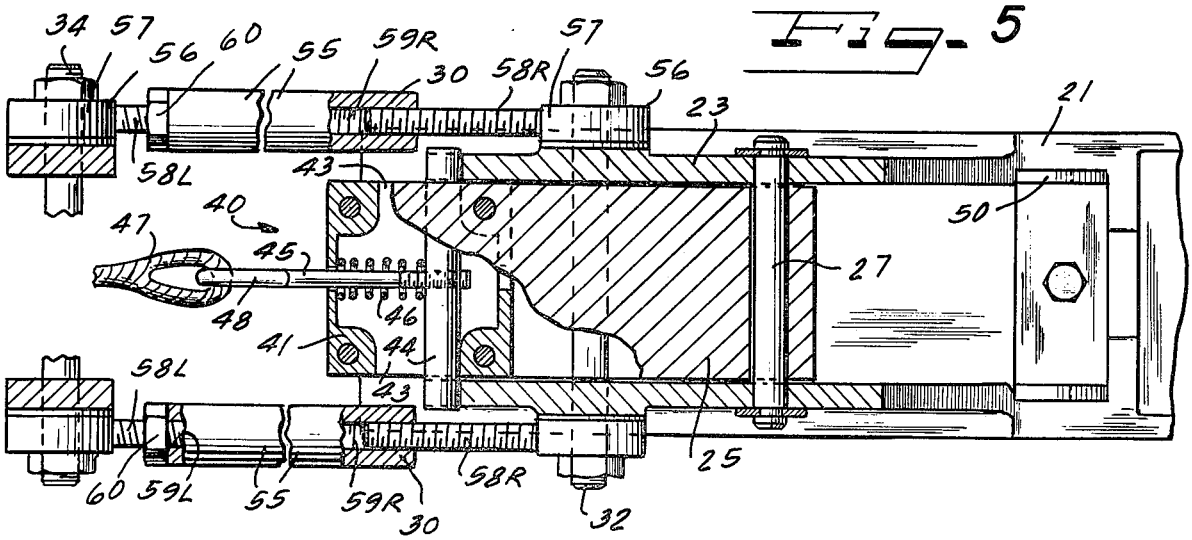
FIG. 5 is a top plan view, partly broken away, of the adjustment and locking means of the invention.

A locking apparatus 40 holds the mounting bracket in its extended and retracted positions as is shown in FIGS. 4 and 5. A lock housing 41 is affixed to one face of the center arm 25 by any convenient means such as screws 42. The housing 41 has side openings 43 in which a locking bar 44 is slidable. A control pin 45 passes through a wall of the housing 41 and threadably engages the center of the locking bar 44, for external control of the position thereof. A coil spring 46 about the pin 45 and between the housing wall and the bar biases the bar 44 into its locking position closer toward the pivot axis 26. A rope 47 engages a hook 48 on the pin 45 for remote manual control of the position of the locking bar 44.

Either end of the locking bar 44 is engageable in the retracted position of the center arm 45 with a lock receptacle notch 49 formed in the inboard portion of the ears 23 on the base plate 21. The receptacle 49 is spaced well apart from the first pivot axis 26 and pin 27 on which the center arm 25 is pivotable, fixing the locked orientation of the center arm 25 and, in accordance with the principles of the invention, also fixing the position of the second pivot axis 28 on which the hinge bracket 36 pivots in the retracted position. For locking the mounting bracket 20 in its extended position, as in FIG. 1, a forward locking bracket 50 is provided forwardly of the ears 23, for engagement of the locking bar 44 in a further recess 51. In the extended position, the center arm 25 is held against upward movement between the pivot pin 27 and the locking recess 51; it is also supported by the resilient pad 22 bearing against the undersurface of the extended center arm 25.

In accordance with the principles of the invention, the distance between the third and fourth pivot axes along the side arms 30, 30 in the embodiment shown is made adjustable. Each side arm 30 comprises a center rod 55 and a pair of opposite rod ends 56. Each rod end 56 comprises a head 57 which receives the pivot pin 32 or 34 therethrough. A threaded portion 58 extends from one side of the head 57 for engagement in threaded end portions 59L, 59R of the rod 55, as in FIG. 5. Opposite ends of the rod 55 are threaded with opposite-hand threads 59L, 59R as shown, and the threaded rod end portions 58 are formed with corresponding threads 58L, 58R of opposite hands from one another. Thus turning the rods 55 about their own axes will cause the rod ends 58 to pass further into or further from the interiors of the rods 55, selectively shortening or lengthening the distance between the third and fourth pivot axes 31, 33. Lock nuts 60 secure the rods 55 rotationally.

Various modifications to the exact structure shown may be readily devised by those skilled in the art without departing from the scope of the present invention. The center arm 25 could be made adjustable rather than the side arms 30, and the lock mechanism 40 may be placed on one or both side arms 30 instead of on the center arm 25. Only a single threaded rod end 58 need be employed, so long as the rod portion 55 is held rotatably on the other rod end 56. Further, other methods of varying the spacing along the amrs 25 or 30, 30 between the pivot axes 26 and 28 or 31 and 33, not employing threaded rod portions, may also be devised.

As depicted in FIG. 3, once the center arm 25 has been positioned and locked between the lock recess 49 and the first pivot pin 27, the second pivot pin 29 supporting the hinge bracket 36 is also fixed in space. Shortening the side arms 30 will thus pivot the hinge bracket 36 so that the pivot pin 34 at the fourth pivot axis 33 will follow an arc 59, in FIG. 3, about the pivot axis 28. Such pivoting of the hinge bracket 36 will also pivot the trolling motor shaft 14 about the pivot axis 28 or pivot pin 29. The motor housing 13 on the lower end of the shaft 14 is thus selectively raised or lowered along an arc 61 with respect to the resilient pad 22 carried on the base plate 21. Such adjustment along the arc 61 directly controls the preloading between the motor housing 13 and the resilient pad 22 by adjusting the pivot axis spacing lengths of the side arms 30, after assembly of the mounting bracket 20 to the trolling motor 11 and attachment of the base plate 21 to the boat deck 12. Application of a substantial preloading force downwardly on the motor 13 prevents bouncing of the motor during trailering and high-speed motoring of the boat 10, wherein pounding forces may be greatly magnified on the bow of the boat. The present adjustment device is particularly beneficial where the submersion depth of the motor housing 13 is changed by sliding the shaft 14 through the hinge bracket 36. Unless the shaft 14 were exactly parallel to the resilient base 22, changing the position of the motor 13 along the pad 22 would change the preloading force therebetween. Thus, after adjustment of the motor 13 for ideal submersion depth, the side arms 30 may be readjusted to provide the desired preloading force.

A further benefit of the adjustment feature of the present invention is that different-sized motor housings 13 may be employed in a run of trolling motors without changing any of the castings employed in the hinge bracket 36 or the base plate 21. Simple adjustment to the pivot axis spacing along the side arms 30 can accommodate a wide range of diameters of motor housings 13. The adjustability of the side arms 30 is also important in accommodating minor manufacturing variations in spacings among the four pivot axes 26, 28, 31, 33. Because the shaft 14 is very long in relation to the spacing between pivot axes 28 and 33, small changes in the spacing of such axes can result in major variations in the final position of the motor housing 13 with respect to the resilient pad 22. Adjustability of the arms 30 eliminates all such problems. Finally, the adjustability of the arms 30 permits the motor housing 13 to be repreloaded against the pad 22 after aging of the rubber or other material thereof.

Although various minor modifications may be suggested by those versed in the art, it should be understood that I wish to embody within the patent warranted hereon all such modifications as reasonably and properly come within the scope of my contribution to the art.

I claim as my invention:

1. In a mount for an outboard electric trolling motor, the mount comprising an elongate base plate attachable to the boat deck, the base plate having a pair of upstanding parallel ears on an inboard end portion thereof and an elongate outboard end portion bearing a resilient pad on a top side thereof, a first arm unit comprised of a center arm pivoted on said ears on a first end thereof at a first pivot axis and a second arm unit comprised of a pair of side arms pivoted on said ears on first ends thereof on a common second pivot axis spaced inboard of said first axis, opposite, second ends of the center arm and side arms being connected on further, spaced-apart pivot axes to respective lower and upper pairs of inboard extending boss portions of a hinge bracket for receiving therethrough and carrying a shaft of the trolling motor, the shaft carrying a propulsion motor on a lower end thereof, the arms being of selective lengths and attached to said hinge bracket at selected positions for orienting the hinge bracket and shaft in a generally vertical position outboard of the boat and in a generally horizontal, retracted position inboard and overlying the boat deck with the propulsion motor lying on the resilient pad, the improvement comprising:

a lock means carried on one of said arms units and a lock receptacle means on said base plate for engaging said lock means in the retracted position of the arm units; and one of said arm units having axial adjustment means therein for selectively shortening and lengthening the pivot axis spacing of said one of said arm units, to vary the pivotal orientation of the hinge bracket and hence of the motor shaft with respect to the other of said arm units and to vary a downward stabilizing preloading force applied onto said propulsion motor, biasing same substantially immovably into the resilient pad.

2. In a mount as defined in claim 1, the improvement thereof wherein the lock means is carried on the center arm and the side arms have said axial adjustment means therein.

3. In a mount as defined in claim 1, the improvement thereof, wherein the adjustment means comprises:

a pair of rod ends each receiving a pivot axis through a head end thereof and at least one of said rod ends having a threaded opposite portion; and a rod carried rotatably on and extending between the rod ends and having a threaded end portion cooperating with each threaded portion of the rod ends, for length adjustment between said pivot axes by turning the rod selectively about its axis to thread it further onto or from each threaded rod end.

4. In a mount as defined in claim 3, the improvement thereof, wherein both of the rod ends and both end portions of the rod are threaded, each end with an opposite-hand thread, so that turning the rod will selectively shorten or lengthen the distance between the rod and pivot axes.

5. An adjustable-arm mount for an outboard electric trolling motor, the trolling motor having a shaft and a propulsion motor carried on one end of the shaft, the mount having an extended, outboard position and a retracted, inboard position and comprising:

a base plate attachable to a deck of a boat and having a resilient pad affixed to an outboard portion thereof;

a pair of spaced-apart ears affixed to the base plate;

a first arm unit;

said first arm unit comprising a center arm pivoted at an axis on a first end thereof to the ears and having a free second end;

a second arm unit, said second arm unit comprising a pair of side arms each pivoted at one end thereof to the ears at an axis spaced inboard from the center arm pivot axis and also having a second, free end;

a hinge bracket having lower and upper pairs of inboard extending boss portions carried on a first bracket part for pivotably engaging the second ends of the center and side arms at spaced-apart axes thereon, and having a second bracket part removably connected to an outboard side of said first bracket part, said bracket parts forming a cylindric bore for engaging and supporting the trolling motor shaft; and a lock means carried on one of said arm units cooperably with the base plate and ears for securing the mount in its retracted inboard position; and wherein one of said units has adjustment means thereon for varying axial spacing between the first and second pivot axes thereon, whereby when the mount is in its retracted position the hinge bracket may be pivoted about its connection to the other one of said arm units by selective varying of the length between the pivot axes of said one of said arms units to apply a selected stabilizing preloading force to the propulsion motor as against the resilient pad.

6. An adjustable-arm mount as defined in claim 5, wherein the adjustment means is provided in the one of the arm units not carrying the lock means.

7. An adjustable-arm mount as defined in claim 6, wherein the lock means is on the center arm and the side arms have said adjustment means therein.

8. An adjustable-arm mount as defined in claim 5, wherein the adjustment means comprises:

a pair of rod ends each receiving therethrough said pivot axis and at least one of said ends having a threaded end portion; and a rod rotatably engaging and carrying each of the rod ends and having a threaded end at each threaded rod end portion, whereby turning the rod on its axis shortens or lengthens the pivot axis spacing therealong.

9. An adjustable-arm mount as defined in claim 8, wherein both rod ends have threaded end portions and each said rod is threaded at both ends, the threads on opposite rod ends and on the rod at opposite ends having opposite hands, so that turning the rod on its axis will thread the rod ends further onto or from the rod.

10. An adjustable-arm mount for an electric outboard trolling motor, the trolling motor having a shaft and a propulsion motor housing carried on a lower end of the shaft, the mount comprising:

an elongate base plate attachable to a boat deck and having a pair of integral, upstanding ears carried on an inboard portion thereof and a resilient pad affixed to an outboard, upper portion thereof;

a rigid center arm pivoted at a first pivot axis thereon between said ears of said base plate and having a a second, opposite end with a second pivot axis therein;

a pair of side arms pivoted at a third pivot axis thereon to said ears of said base plate and having fourth, opposite ends with a fourth pivot axis therein;

locking means carried on said center arm and selectively engageable with an inboard portion of said base plate for locking the center arm into an inboard, retracted position;

a hinge bracket having a first bracket part carrying lower and upper pairs of inboard extending boss portions which pivotally engage said center and side arms respectively at said second and fourth pivot axes, and having a second bracket part removably connected to an outboard side of said first bracket part, said bracket parts forming a cylindric bore for carrying said shaft of said trolling motor;

the first pivot axis being outboard of and higher from said deck then the third pivot axis, and the distance between the first and second pivot axes being immovably fixed at less than that between the third and fourth pivot axes, and the space separating the first and third pivot axes being immovably fixed at less than that between the second and fourth pivot axes; and an adjustment means on each of said side arms for varying the spacing between the third and fourth pivot axes, whereby when the center arm is locked in the inboard position, the hinge bracket is pivotable at said lower boss portions about the second pivot axis on said center arm and can be oriented under the control of the adjustment means on the side arms selectively to raise and lower the motor housing with respect to the resilient pad and to preload said housing selectively onto said pad thereby providing means for retaining said housing in substantially immovable fashion until readjustment.

11. An adjustable-arm mount as defined in claim 10, wherein each said adjustment means comprises a threaded connection between a member pivoting about one of the third and fourth pivot axes and a rod extending rotatably between said member and the other of said pivot axes.

12. An adjustable-arm mount as defined in claim 11, wherein the adjustment means comprises:

a pair of said members pivoting about each of the third and fourth pivot axes and each having a threaded coupling end of an opposite-hand thread from the other; and said rod cooperatively and threadably engaging both said members; whereby turning the rod in one direction shortens the pivot axis spacing and turning it in the other direction lengthens said pivot axis spacing.

* * * * *